US009210992B2

(12) United States Patent
deBeers

(10) Patent No.: US 9,210,992 B2
(45) Date of Patent: Dec. 15, 2015

(54) BEVERAGE BOTTLE AND RETAINING CLIP ASSEMBLY

(71) Applicant: James E. deBeers, River Forest, IL (US)

(72) Inventor: James E. deBeers, River Forest, IL (US)

(73) Assignee: Running Health LLC, River Forest, IL (US)

( * ) Notice: Subject to any disclaimer, the term of this patent is extended or adjusted under 35 U.S.C. 154(b) by 207 days.

(21) Appl. No.: 13/951,329

(22) Filed: Jul. 25, 2013

(65) Prior Publication Data

US 2014/0027477 A1 Jan. 30, 2014

Related U.S. Application Data

(60) Provisional application No. 61/675,803, filed on Jul. 25, 2012, provisional application No. 61/774,570, filed on Mar. 7, 2013.

(51) Int. Cl.
*A45F 5/02* (2006.01)

(52) U.S. Cl.
CPC . *A45F 5/02* (2013.01); *A45F 5/021* (2013.01); *A45F 2200/0583* (2013.01)

(58) Field of Classification Search
CPC ..... A45F 3/16; A45F 3/18; A45F 2200/0583; B60N 3/103; A47G 23/0225
USPC ..... 224/148.1–148.7, 162
See application file for complete search history.

(56) References Cited

U.S. PATENT DOCUMENTS

| | | | | |
|---|---|---|---|---|
| 3,212,660 | A * | 10/1965 | Adell | 248/313 |
| 5,971,238 | A * | 10/1999 | Malvasi et al. | 224/148.6 |
| 6,182,874 | B1 * | 2/2001 | Feldman, Jr. | 224/259 |
| 6,279,794 | B1 * | 8/2001 | Miyazaki | 224/148.7 |
| 2005/0258201 | A1 * | 11/2005 | Willows et al. | 224/148.4 |
| 2006/0011676 | A1 * | 1/2006 | Willows et al. | 224/148.4 |
| 2010/0051660 | A1 * | 3/2010 | Noffsinger | 224/201 |
| 2010/0206919 | A1 * | 8/2010 | Boyom | 224/148.4 |
| 2011/0056907 | A1 * | 3/2011 | Willows et al. | 215/382 |

* cited by examiner

*Primary Examiner* — Adam Waggenspack
(74) *Attorney, Agent, or Firm* — Richards Patent Law P.C.

(57) ABSTRACT

A wearable beverage bottle retaining clip includes: a back wall, including a top portion, bottom portion, a front face, and a rear face; two shoulder tabs, each extending in front of the top portion of the back wall such that a first end of each shoulder tab is located in front of the front face of the back wall, wherein the shoulder tabs are at least partially hook-shaped and the first end of each shoulder tab is spaced apart across a width of the back wall; and a retaining seat extending in front of the bottom portion of the front face of the back wall, wherein the retaining seat includes a bottom tab that is configured such that when a beverage bottle is secured in the retaining clip, the bottom tab is in contact with the front face of the beverage bottle.

9 Claims, 5 Drawing Sheets

BEVERAGE BOTTLE AND RETAINING CLIP ASSEMBLY

CROSS-REFERENCE TO RELATED APPLICATIONS

This application claims the benefit of U.S. Provisional Application No. 61/675,803 filed on Jul. 25, 2012, and U.S. Provisional Application No. 61/774,570 filed on Mar. 7, 2013, each of which is incorporated herein by reference in its entirety.

BACKGROUND OF THE INVENTION

The present subject matter discloses a beverage bottle and retaining clip assembly adapted for use during physical activity, such as running or other exercise. The beverage bottle and retaining clip assembly provide a user secure, quick-release, access to a beverage bottle while engaged in physical activity.

Distance running and similar long-duration activity (e.g. hiking, distance walking, etc.) are demanding for the participant, not the least of which is ensuring proper hydration and nutrition throughout the duration of the activity. Particularly since these types of activities can be performed in nearly limitless conditions, and because the participant may not wish to disrupt the activity to address hydration and nutrition needs, it is important to be able to carry one or more beverages throughout the activity and to be able to quickly and securely access the one or more beverages with minimal disruption to the activity.

Numerous attempts to solve these problems have been tried. Some attempts have been made to provide handheld beverage bottles and adjustable hand straps. Others have attempted to provide beverage bottles that attach to a belt, waistband, or similar strap through clips, straps, holsters, etc. Each provides advantages and disadvantages; however, the present subject matter deals with improving the design and function of beverage bottles and retaining clip attachments for use with belts or similar straps.

There are many important design considerations for designing beverage bottles and clip attachments for use with belts or similar straps. Prior attempts to address the needs of participants in such activities have failed to balance the varied design considerations in a way that solves all of the following considerations.

Stability of the beverage bottle and the retaining clip is essential to user comfort. Users do not like a bottle that bounces against their body as they run. In addition, the security of the bottle in the retaining clip and the security of the bottle to the user's body improve the effectiveness and comfort of the system. A beverage bottle that does not stay in place within the retaining clip is at least a distraction to the user during the activity. In worse case scenarios, the user may lose the bottle during the activity if it is not held in place. In addition to the distraction and potential loss of the bottle, if the retaining clip will not remain secure in place against the user's body, the retaining clip will be uncomfortable.

While the stability of the bottle and the retaining clip are important, it is equally important that the bottle is easy to remove from the retaining clip when the user desires. If the user cannot easily remove the bottle, it will be a distraction from the activity when it comes time to use the bottle. The appropriate balance between security and ease of access is essential for a quality design.

There is also a delicate balance between the distance from the body the bottle sits on the user and the amount of padding provided between the retaining clip and the user's body.

While it is more comfortable and stable for the user when the bottle securely sits closer to the user's body, some amount of padding between the user and the bottle and retaining clip may also improve the comfort of the system. It is a challenge to provide an appropriate amount of cushioning without moving the bottle and retaining clip too far from the body.

With respect to positioning on the body, there is a balance to be had between securing the bottle in a position that is out of the way of the user while not making the bottle too difficult to reach. For example, it is easier for a user to grab towards his or her lower back as it requires less arm flexibility than a location higher up the user's back. Accordingly, the vertical grip location of the bottle may be one of the critical design elements.

A further issue of comfort is the problem of ride-up with body-mounted bottle systems. Ride-up occurs when bottle systems, such as those secured by a belt, move up the waist in response to user movement while running. Ride-up is uncomfortable and distracting, prompting runners to slow or stop to adjust the system. Existing systems, such as belt-based bottle holster systems, increase ride-up by requiring the user to remove the bottle by pulling the bottle up and out of the holster. As the user pulls the bottle up, the belt may be pulled up with the bottle until it is released. Thus, it is important that the forces imparted during removal and re-seating of the bottle minimize ride-up.

To be effective, a user must be able to remove the bottle from the retaining clip without accidentally discharging the fluid from the bottle. In order to do so, the user must be able to apply enough force to the bottle to release it from the retaining clip without activating the valve or otherwise cause the bottle to squirt its contents. Design considerations related to these features include the strength of the bottle walls, the strength of the retaining clip's retention of the bottle, the valve design, etc.

Another common issue with the design of beverage bottles and clip attachments for use with belts or similar straps is the difficulty the user faces in reseating the bottle into its retaining clip. Because the user will be active when using the product, it is important for the bottle and retaining clip to be easy to reseat. Moreover, because many users prefer to wear their bottles on their backs, the reseating of the bottle into the retaining clip is a "blind activity." Accordingly, the seating mechanism should be designed to assist in preventing improper alignment and improper loading of the bottle into the retaining clip during physical activity in which the user may not be able to direct much attention to the act of reseating the bottle.

Numerous additional design considerations must be balanced to provide an appropriate solution. For example, the retaining clip height must not be so large and/or obtrusive that it interferes with the bending of the waist or lower back of the user, there must be minimal side-to-side play in the retention of the bottle to the clip and the retention of the clip to the user's belt, the shape of the bottle must be comfortable for the user, etc.

As can be seen, there are numerous design considerations to be balanced to provide an appropriate system to address the needs of active users of hydration systems. Accordingly, there is a need for a beverage bottle and retaining clip assembly that provide a user secure, quick-release, access to a beverage bottle while engaged in physical activity, as described and claimed herein.

BRIEF SUMMARY OF THE INVENTION

The present disclosure provides a beverage bottle and retaining clip assembly that provide a user secure, quick-release, access to a beverage bottle while engaged in physical activity. More specifically, the present subject matter discloses an injection molded plastic assembly with spring clip and pad for releasably securing a beverage bottle therein. Various examples are provided herein.

In one embodiment, the beverage bottle and retaining clip assembly provided herein includes a blow molded beverage bottle and cap. The cap may include a valve that releases fluid when the bottle is squeezed, but sealed during regular use. In various embodiments, the valve may be a silicone J or "Zel" valve, a spray valve, a bite valve, a dual valve, etc.

In the preferred embodiment, a retaining clip, including a retaining seat and two shoulder tabs, holds the bottle in place in a snap-fit connection. The retaining seat may include a bottom tab extending from the retaining seat that mates with a bottom pocket at the bottom of the bottle and the two shoulder tabs may secure the shoulder of the bottle around the shoulder of the bottle.

In use, the bottle snaps out from the shoulder tabs of the retaining clip and away from the bottom of the retaining clip. For re-seating, the bottom is toed into the retaining clip first and then the top of the bottle is snapped in place with the bottle cap being centered between the two shoulder tabs.

In one embodiment, a retaining clip bottle holder is mated to a retaining clip base via a pivot and the two elements are secured together via a metal spring. Accordingly, the retaining clip bottle holder and retaining clip base form a spring-loaded clamp that may be secured to a person's waistband similar to the clamping action of a plastic clothes hanger. Squeezing the bottle cap and a finger pivot tab in the retaining clip base may actuate the clamp. The finger pivot tab portion of the retaining clip base may angle away from the user's body for easier access. Raised plastic ridges may be molded into the clip holder and retaining clip base to improve the grip of the clamping action of the system.

The pivot is located as high as reasonable to stabilize the beverage bottle and retaining clip assembly on a waistband or belt. As a result, the center of gravity of the bottle is as low as possible with respects of the top of the waistband or belt.

The clip base may further include a pad attached to improve the user's comfort. In certain embodiments, the pad may be foam and may include an ID holder included for personal safety information and/or a key recess to securely store a house key or similar item. The storage space may be accessed using a storage tab. The upper portion of the retaining clip base and/or pad curves away from the body. This creates some area for a finger to slide next to the body to open the clamp for removal of the retaining clip.

It is believed that one of the keys to the improved function of the present design is in providing a wide and deep, padded, retaining clip base for maximum stability and comfort. The deep padded retaining clip base creates a longer pivot arm and helps to limit rocking of the bottle away from the body from flexing of the user's waistband. In addition, by locating the center of gravity of the bottle as close to the body as possible, it is possible to reduce or eliminate bottle rocking, even in heavy use conditions.

The pad may be an elastomeric fabric pad that is slid on from the bottom of the retaining clip base up to the pivot and then stretched around the finger pivot tab to secure the pad in place. In such embodiments, the user may remove the fabric pad for cleaning. Thinner versions of the pad may increase the stability of the system. Thicker versions may be more comfortable. A higher friction material, such as silicone, may be used on the pad to keep it in place on the skin under sweaty conditions. The higher friction material may be provided as small circular bumps or strips of the material used on the inside of cycle shorts to keep the pad in place. Alternatively, an elastomeric or rubber like paint may be used. While clipped on a belt, the higher friction material may help to reduce movement with respects to shirt or short fabric, which may otherwise have a low coefficient of friction.

It is contemplated that there are numerous bottle shapes that may be employed in the presently disclosed system. The bottle shapes may assist in the function and efficiency of the system. For example, in one embodiment, the bottle may contour inward to conform to the user's hand and fingers. The inward contour of the bottle may assist in improving the user's grip of the bottle. In another example, the bottle may contour outward and include finger recesses at the top and bottom of the bottle to improve the user's grip of the bottle. It is contemplated that both examples of bottles may fit into the same retaining clip.

The design of the retaining clip has been optimized to reduce failed attempts to re-seat the bottle during physical activity. The sides of the retaining seat of the retaining clip are curved and tapered to help center the bottle in place before snapping the shoulders of the bottle into place in the retaining clip. The retaining clip may be made of polymeric material that stretches elastically when the bottle is loaded incorrectly. The minimum point of deformation is achieved when the bottle is properly loaded. The deformation of the retaining clip or the bottle may provide feedback to the user indicating that the user is attempting to load the bottle at an incorrect orientation. Further, the deformation caused by mis-loading may gently nudge the bottle into the correct orientation.

Additionally, the bottom tab may act as a guide during loading by engaging the bottom pocket to encourage the bottle to slide into place. The bottom tab is adapted to mate with the bottom of the bottle. The bottom tab is rounded to permit the bottom tab to engage the bottom pocket from numerous angles. Even further, when angled for insertion, the depth of the bottom of the bottle is greater than the distance between the bottom tab and the opposing wall of the retaining clip. Thus, during insertion, the bottle may gently deform the bottom tab and consequently the bottom tab will exert a restoring force on the bottle towards the proper seating orientation. The height and width of the bottom tab may improve the bottom tab's ability to seat the bottle. This is especially important in assisting the user in properly "blindly" loading the bottle at a position along the user's lower back.

It is difficult to remove the bottle without squeezing it slightly. In some embodiments, the bottle tapers inward from the shoulder to the waist of the bottle and flairs outward from the waist to the bottom of the bottle. When squeezed near the shoulder, the waist of the bottle expands slightly outward increasing the volume of the bottle and preventing accidental discharge that otherwise may occur due to removing the bottle from the retaining clip.

Unlike prior designs, the system provided herein does not require squeezing the sides of the bottle inward to release it from the retaining clip. The presently disclosed system does not require any additional clip manipulation; the user must simply pull the bottle from the two shoulder tabs of the retaining clip bottle holder. The secure and alignment assisting seating mechanism formed by the interaction between the bottle and the retaining clip body help to properly seat the bottle within the clip and help to prevent the bottle from popping out of the retaining clip.

It is contemplated that by designing the back wall of the retaining clip bottle holder to be as narrow as possible, there is a greater grip area along the sides and some in back of bottle. It is contemplated that the increased grip area is important in preventing hand slippage, particularly when wearing running gloves or with wet or sweaty hands. The inward contour and/or finger recesses also provide a mechanical advantage and undercut surface to improve grip of the bottle. By making the bottle narrow around the waist, the bottle is easier to grip around the perimeter by users with smaller hands, and the bottle is prevented from easily sliding up or down in the user's hand. In further embodiments, grip is improved by including patches of rough texture at expected grip points, such as the back waist of the bottle.

The retaining clip bottle holder and/or retaining clip base may include one or more stiffening ribs. The ribs may function to reduce flex and to secure the bottle to a greater degree. The ribs may also improve the grip of the clamp action of the retaining clip. Further, the retaining clip bottle holder and/or retaining clip base may include vent holes that permit airflow through the retaining clip to promote a cool, dry interface with the user's skin during physical activity.

It is contemplated that the bottle may be further secured within the retaining clip through the use of a small elastomeric band that acts as a strap to secure the bottle to the retaining clip around the valve portion of the cap. The elastomeric band may engage the cap valve to improve the retention of the bottle and may easily be manipulated out of the way to enable the bottle to be easily removed as described herein. The elastomeric band is able to retract back into a channel in the retaining clip base and move clear of the bottle and cap reseating area. While some existing systems have used elastomeric bands, they do not move away from the bottle seating mechanism and may cause reseating issues.

In alternate embodiments of the present subject matter, the retaining clip is designed to mate with a belt or armband. In these embodiments, the retaining clip may include a belt clip bottle holder that includes a passage for securing the retaining clip to a belt. The retaining clip further includes belt pad to provide stability to the retaining clip and to pad the interface between the retaining clip and the body. The belt pad may include a belt pad strap fabric, belt pad fabric, belt pad foam, and belt pad chamois. The belt pad strap fabric may secure the belt pad to the belt clip bottle holder. The belt pad strap fabric may be secured to the belt pad fabric by sewing, gluing, etc. The belt pad fabric and the belt pad chamois may enclose the belt pad foam and may be joined by sewing, gluing, etc.

It is contemplated that there are numerous bottle shapes that may be employed in the presently disclosed system. The bottle shapes may assist in the function and efficiency of the system. For example, as described, the bottle may contour inward to conform to the user's hand and fingers. The inward contour of the bottle may assist in improving the user's grip of the bottle. Alternatively, the bottle may be adapted to have increased rigidity by providing side contours and finger recesses that aid in preventing unplanned squirting while removing the bottle from the retaining clip. Further, the bottle may contour outward and include finger recesses at the top and bottom of the bottle to improve the user's grip of the bottle. It is contemplated that each example of the bottles described may fit into the same retaining clip.

In one embodiment, a wearable beverage bottle retaining clip includes a back wall, including a top portion, bottom portion, a front face, and a rear face; two shoulder tabs, each extending in front of the top portion of the back wall such that a first end of each shoulder tab is located in front of the front face of the back wall, wherein the shoulder tabs are at least partially hook-shaped and the first end of each shoulder tab is spaced apart across a width of the back wall; and a retaining seat extending in front of the bottom portion of the front face of the back wall, wherein the retaining seat includes a bottom tab that is configured such that when a beverage bottle is secured in the retaining clip, the bottom tab is in contact with the front face of the beverage bottle. In some examples, at least one shoulder tab includes a mating protrusion located near the first end of the shoulder tab. In additional examples, the back wall is pivotally attached to a retaining clip base. In some further examples, an elastomeric band including a pull tab that is retractable into a channel located inside the retaining clip base. In even further examples, the retaining clip base includes a pad. Moreover, in some examples, the retaining clip base further includes at least one vent hole. In yet further examples, the shoulder tabs are integrally formed with the back wall. In additional examples, the retaining seat is integrally formed with the back wall. In further examples, the sides of the retaining seat are curved and tapered. In even further examples, the back wall includes inwardly contoured sides.

In another embodiment, a wearable beverage bottle retaining clip includes snap-fit seating and securing mechanism including a retaining clip bottle holder hingedly connected to a retaining clip base, a pair of shoulder tabs extending from the retaining clip bottle holder, and a retaining seat, wherein the retaining seat is configured to secure the base of a beverage bottle through contact with a front and a rear of the beverage bottle, wherein the shoulder tabs are configured to secure a shoulder portion of the beverage bottle by each wrapping around a respective portion of the shoulder portion of the beverage bottle. In some examples, the shoulder tabs are elastomeric. In additional examples, the shoulder tabs exert pressure on the shoulder portion of the beverage bottle through elastic deformation of the shoulder tabs. In further examples, the retaining seat is elastomeric. In even further examples, the retaining seat exerts pressure on the base of the beverage bottle through elastic deformation of the retaining seat.

In a further embodiment, a snap-fit beverage bottle and retaining clip assembly includes a beverage bottle including a shoulder portion including a pair of shoulder pockets and a base including bottom pocket; and a snap-fit seating and securing mechanism into which the beverage bottle is secured, wherein the snap-fit seating and securing mechanism includes a retaining clip bottle holder hingedly connected to a retaining clip base, a pair of shoulder tabs extending from the retaining clip bottle holder, and a retaining seat including a bottom tab, wherein the retaining seat is configured to secure the base of the beverage bottle wherein the bottom tab cooperates with the bottom pocket of the beverage bottle to assist in securing the beverage bottle, wherein the shoulder tabs are configured to secure the shoulder portion of the beverage bottle by each wrapping around a respective shoulder portion of the beverage bottle such that the shoulder tabs cooperate with the shoulder pockets of the beverage bottle to assist in securing the beverage bottle. In some examples, the beverage bottle further includes a concave waist portion that is narrower than the shoulder portion. In additional examples, the beverage bottle further includes a convex waist portion that is wider than the shoulder portion. In further examples, at least one shoulder tab includes a mating protrusion located near the first end of the shoulder tab that mates within the respective shoulder pocket of the beverage bottle. In even further examples, the shoulder tabs and the retaining seat are elastomeric.

An advantage of the system provided herein is it provides an improved mechanism hands-free carrying of hydration and nutrition bottles during physical activity.

Another advantage of the system provided herein is the clamping feature may be used with a belt and waistband to assist in securing the belt in place. This prevents ride up of the belt and restriction of the diaphragm, which may restrict the user's breathing. This is believed to be a significant advantage over the existing systems. Clipping the belt to the user's waistband virtually eliminates belt ride up, except for the very opposite end of the belt. Using two clamps may be effective in keeping the entire belt in place. The clamps further prevent the belt from twisting around the body. Further, keeping the belt on the surface of the user's shorts helps reduce rubbing of the edge of the belt on the user's skin, which will cause irritation. The combination of the clip mechanism, belt, and waistband may provide a significantly improved system.

A further advantage of system provided herein is it provides a comfortable and stable solution during user activity.

Another advantage of system provided herein is it provides a snap-fit retention mechanism that provides durable, repeatable, secure, and easy to seat connection between the bottle and the retaining clip.

Yet another advantage of system provided herein is it provides an appropriately padded interface between the system and the user's body.

Still another advantage of system provided herein is it provides a system that may be located close enough to the user's body to improve comfort and security of the system in use.

Another advantage of system provided herein is it provides a bottle that reduces the likelihood of accidental discharge or squirting as the bottle is removed and replaced in the retention clip.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1A:
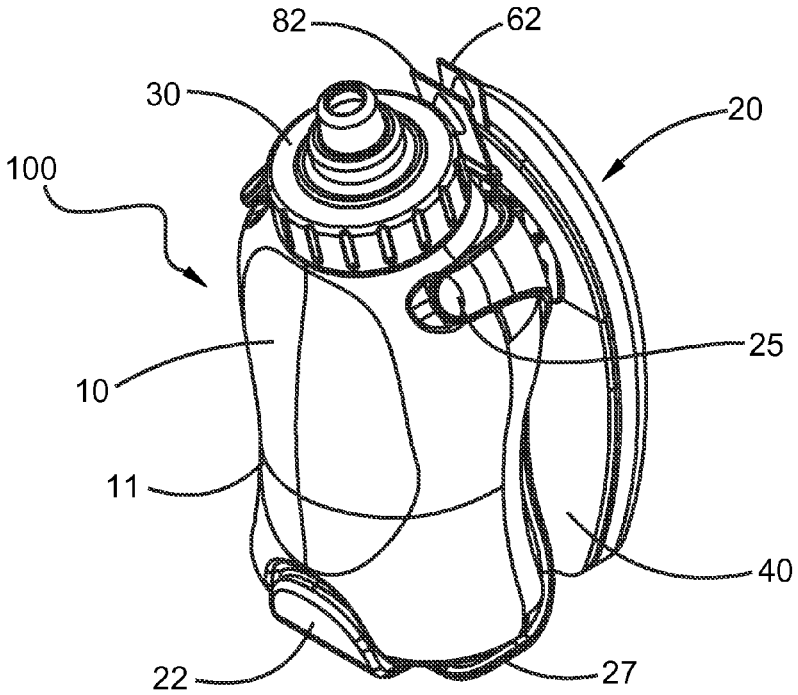
FIG. 1A is a front perspective view of an example of a beverage bottle and retaining clip assembly.
Figure 1B:
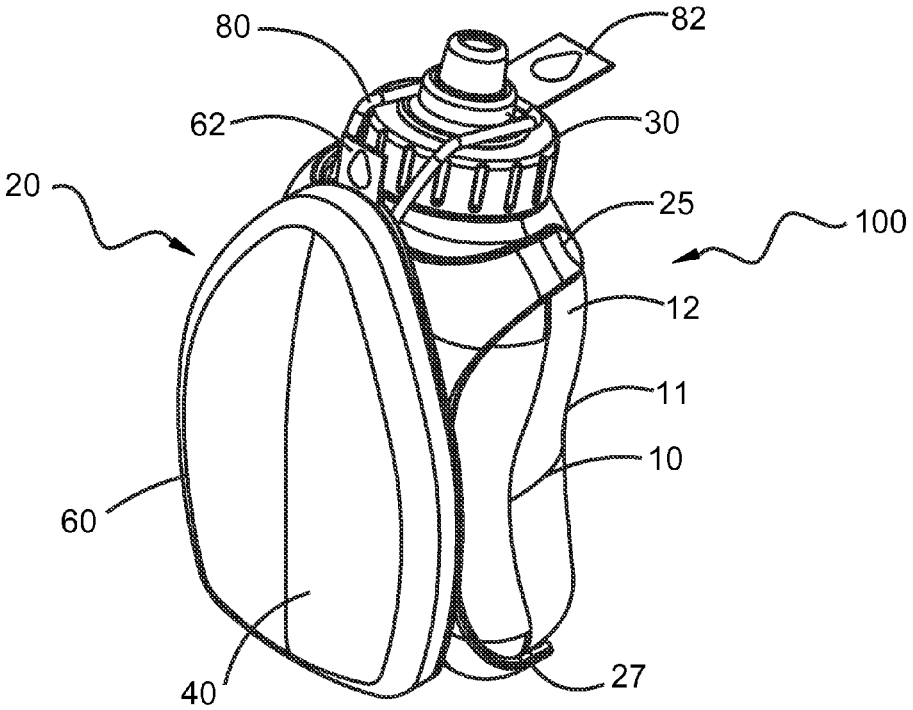
FIG. 1B is a back perspective view of the beverage bottle and retaining clip assembly of FIG. 1A showing the bottle secured in place with an elastomeric band.

In one embodiment, a wearable beverage bottle retaining clip 20 includes a back wall 24, including a top portion, bottom portion, a front face, and a rear face; two shoulder tabs 25, each extending in front of the top portion of the back wall 24 such that a first end of each shoulder tab 25 is located in front of the front face of the back wall 24, wherein the shoulder tabs 25 are at least partially hook-shaped and the first end of each shoulder tab 25 is spaced apart across a width of the back wall 24; and a retaining seat 27 extending in front of the bottom portion of the front face of the back wall 24, wherein the retaining seat 27 includes a bottom tab 22 that is configured such that when a beverage bottle 10 is secured in the retaining clip 20, the bottom tab 22 is in contact with the front face of the beverage bottle 10. In some examples, at least one shoulder tab 25 includes a mating protrusion 26 located near the first end of the shoulder tab 25. In additional examples, the back wall 24 is pivotally attached to a retaining clip base 40. In some further examples, an elastomeric band 80 including a pull tab 82 that is retractable into a channel located inside the retaining clip base 40. In even further examples, the retaining clip base 40 includes a pad 60. Moreover, in some examples, the retaining clip base 40 further includes at least one vent hole 46. In yet further examples, the shoulder tabs 25 are integrally formed with the back wall 24. In additional examples, the retaining seat 27 is integrally formed with the back wall 24. In further examples, the sides of the retaining seat 27 are curved and tapered. In even further examples, the back wall 24 includes inwardly contoured sides.

In another embodiment, a wearable beverage bottle retaining clip 20 includes snap-fit seating and securing mechanism including a retaining clip bottle holder 21 hingedly connected to a retaining clip base 40, a pair of shoulder tabs 25 extending from the retaining clip bottle holder 21, and a retaining seat 27, wherein the retaining seat 27 is configured to secure the base of a beverage bottle 10 through contact with a front and a rear of the beverage bottle 10, wherein the shoulder tabs 25 are configured to secure a shoulder portion of the beverage bottle 10 by each wrapping around a respective portion of the shoulder portion 12 of the beverage bottle 10. In some examples, the shoulder tabs 25 are elastomeric. In additional examples, the shoulder tabs 25 exert pressure on the shoulder portion 12 of the beverage bottle 10 through elastic deformation of the shoulder tabs 25. In further examples, the retaining seat 27 is elastomeric. In even further examples, the retaining seat 27 exerts pressure on the base of the beverage bottle 10 through elastic deformation of the retaining seat 27.

In a further embodiment, a snap-fit beverage bottle and retaining clip assembly 100 includes a beverage bottle 10 including a shoulder portion 12 including a pair of shoulder pockets 16 and a base including bottom pocket 14; and a snap-fit seating and securing mechanism into which the beverage bottle 10 is secured, wherein the snap-fit seating and securing mechanism includes a retaining clip bottle holder 21 hingedly connected to a retaining clip base 40, a pair of shoulder tabs 25 extending from the retaining clip bottle holder 21, and a retaining seat 27 including a bottom tab 22, wherein the retaining seat 27 is configured to secure the base of the beverage bottle 10 wherein the bottom tab 22 cooperates with the bottom pocket 14 of the beverage bottle to assist in securing the beverage bottle 10, wherein the shoulder tabs 25 are configured to secure the shoulder portion 12 of the beverage bottle 10 by each wrapping around a respective shoulder portion 12 of the beverage bottle such that the shoulder tabs 25 cooperate with the shoulder pockets 16 of the beverage bottle 10 to assist in securing the beverage bottle 10. In some examples, the beverage bottle 10 further includes a concave waist portion 11 that is narrower than the shoulder portion 12. In additional examples, the beverage bottle 10 further includes a convex waist portion 11 that is wider than the shoulder portion 12. In further examples, at least one shoulder tab 25 includes a mating protrusion 26 located near the first end of the shoulder tab 25 that mates within the respective shoulder pocket 16 of the beverage bottle 10. In even further examples, the shoulder tabs 25 and the retaining seat 27 are elastomeric.

FIGS. 1A, 1B, 2A, and 2B illustrate an example of a beverage bottle and retaining clip assembly 100. As shown in FIG. 1A, the beverage bottle and retaining clip assembly 100 includes a beverage bottle 10, and retaining clip 20. The retaining clip 20 secures the bottle 10 while the user is engaged in physical activity, and permits the user to quickly release the beverage bottle 10 as needed.

In one embodiment, the beverage bottle and retaining clip assembly 100 provided herein includes a blow-molded bottle 10 including a cap 30. When not in use, the bottle 10 is stowed in the retaining clip 20. The bottle 10 rests on a retaining seat 27 of the retaining clip 20, and is secured in a snap-fit connection by a bottom tab 22 and two shoulder tabs 25. The bottom tab 22 may be a semi-circular hook extending from the retaining seat 27 that mates with a bottom pocket 14 molded into the bottom of the bottle 10. The shoulder tabs 25 may secure the bottle 10 at the shoulder 12. The shoulder tabs 25 may include mating protrusions 26 that are raised features that engage recessed shoulder pockets 16.

Unlike prior designs, the beverage bottle and retaining clip system 100 provided herein does not require squeezing the sides of the bottle 10 inward to release it from the retaining clip 20. In use, the bottle 10 snaps out from the shoulder tabs 25 of the retaining clip 20 and away from the retaining seat 27 at the bottom of the retaining clip 20. For re-seating, the bottom of the bottle 10 is toed into the retaining clip 20 first and then the shoulders 12 of the bottle are snapped in place with the cap 30 being centered between the shoulder tabs 25.

The design of the retaining clip 20 has been optimized to reduce failed attempts to re-seat the bottle 10 during physical activity. The sides of the retaining seat 27 of the retaining clip 20 are curved and tapered to help center the bottle 10 in place before snapping the shoulders 12 of the bottle into place in the retaining clip 20. The retaining clip 20 may be made of polymeric material that stretches elastically when the bottle 10 is loaded incorrectly. The minimum point of deformation is achieved when the bottle 10 is properly loaded. The deformation of the retaining clip 20 or the bottle 10 may provide feedback to the user indicating that the user is attempting to load the bottle 10 at an incorrect orientation. Further, the deformation caused by mis-loading may gently nudge the bottle 10 into the correct orientation.

Additionally, the bottom tab 22 may act as a guide during loading by engaging the bottom pocket 14 (FIG. 3) to encourage the bottle 10 to slide into place. The bottom tab 22 is adapted to mate with the bottom of the bottle 10. The bottom tab 22 is rounded to permit the bottom tab 22 to engage the bottom pocket 14 from numerous angles. Once engaged, the sidewalls of the bottom pocket 14 interact with the sidewalls of the bottom tab 22 to prevent side-to-side movement of the bottle during re-seating. Even further, when angled for insertion, the depth of the bottom of the bottle 10 is greater than the distance between the bottom tab 22 and the opposing wall of the retaining clip 20. Thus, during insertion, the bottle 10 may gently deform the bottom tab 22 and consequently the bottom tab 10 will exert a restoring force on the bottle 10 towards the proper seating orientation. Moreover, the height and width of the bottom tab 22 may improve the bottom tab's ability to seat the bottle 10. This is especially important in assisting the user in properly "blindly" loading the bottle 10 at a position along the user's lower back.

It is difficult to remove the bottle 10 without squeezing it slightly. In the preferred embodiment of the bottle 10 shown in FIGS. 1A-2B, the bottle 10 tapers inward from the shoulder 12 to the waist 11 of the bottle 10 and flairs outward from the waist 11 to the bottom of the bottle 10. When squeezed near the waist 11, the front and back of the bottle 10 expand slightly outward increasing the volume of the bottle 10 and preventing accidental discharge that otherwise may occur due to removing the bottle 10 from the retaining clip 20.

Figure 2A:
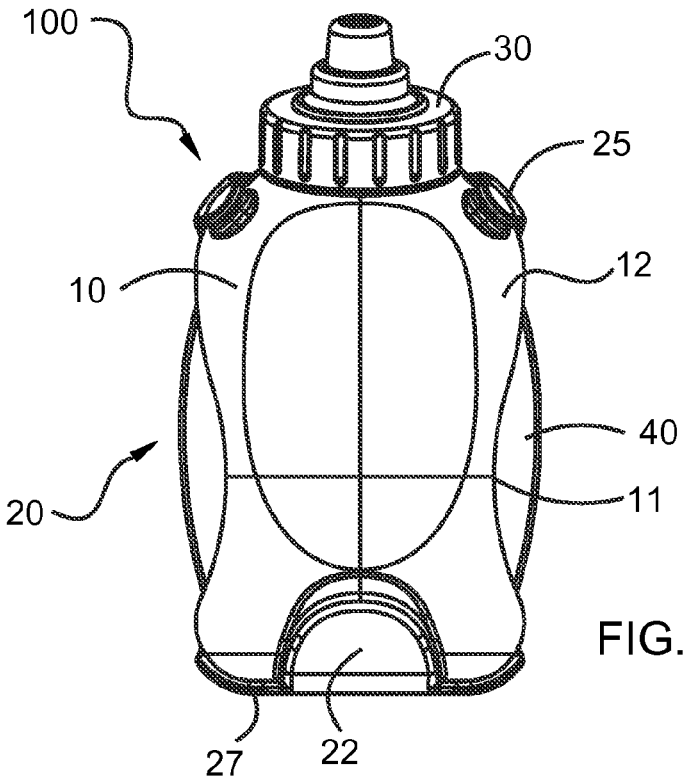
FIG. 2A is a front view of the beverage bottle and retaining clip assembly of FIG. 1A.
Figure 2B:
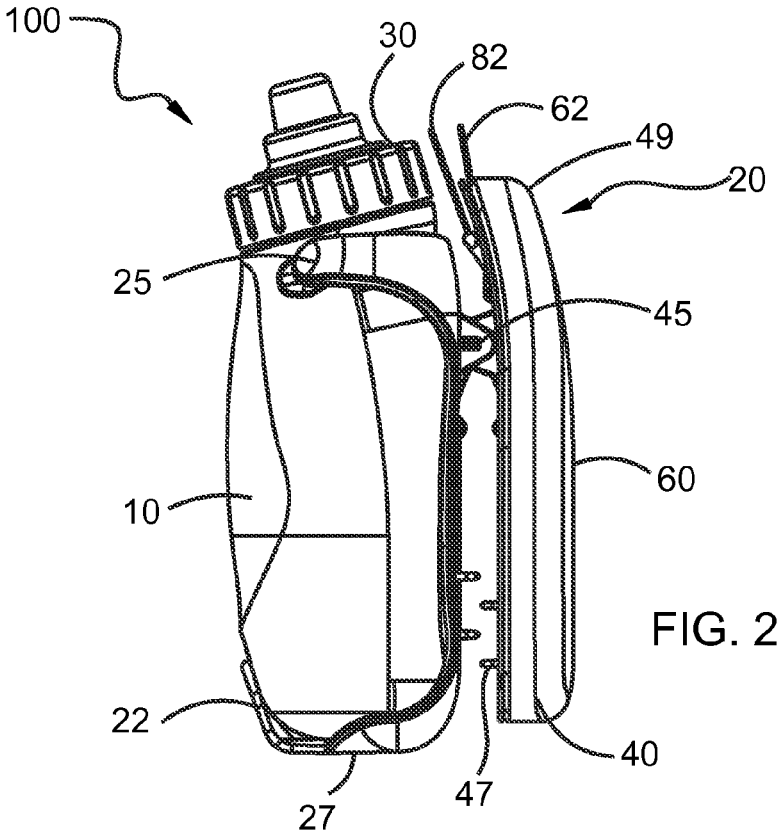
FIG. 2B is a side view of the beverage bottle and retaining clip assembly of FIG. 1A.

As shown in FIG. 2B, in one embodiment, the retaining clip 20 includes a retaining clip bottle holder 21 mated to a retaining clip base 40 at a pivot 45 and the two elements are secured together via a metal spring 50. The retaining clip bottle holder 21 and retaining clip base 40 form a spring-loaded clamp that may be secured to a user's waistband similar to the clamping action of a plastic clothes hanger. Squeezing the cap 30 and a finger pivot tab portion 49 of the clip base 40 may actuate the clamp. The finger pivot tab portion 49 of the retaining clip base 40 may angle away from the user's body for easier access and create some area for a finger to slide next to the body to open the clamp for removal of the retaining clip 20.

As further shown in FIG. 2B, the pivot 45 is located as high as reasonable to stabilize the beverage bottle and retaining clip system 100 on a waistband or belt. As a result, the center of gravity of the bottle 10 is as low as possible with respects of the top of the waistband or belt. Further, raised plastic ridges 47 may be molded into the retaining clip bottle holder 21 and retaining clip base 40 to improve the grip of the clamping action of the beverage bottle and retaining clip system 100.

Figure 3:
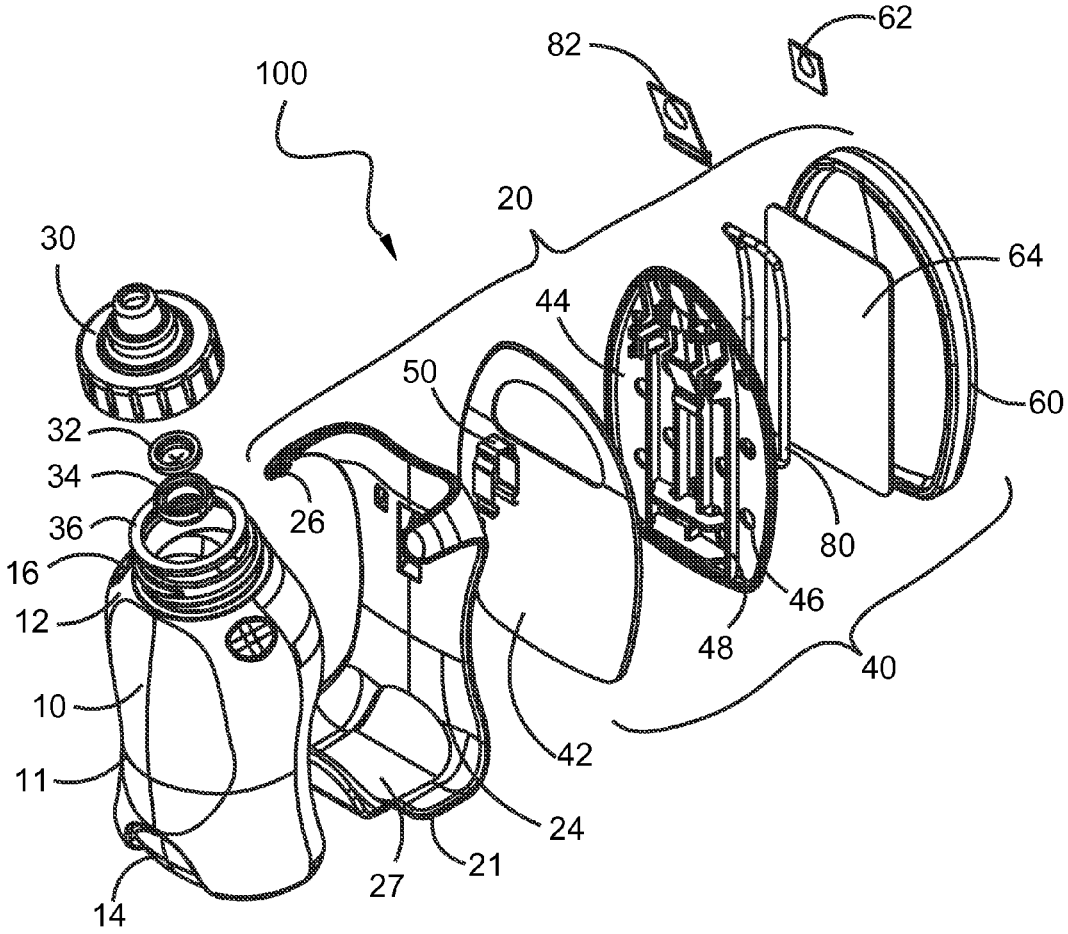
FIG. 3 is an exploded view of the beverage bottle and retaining clip assembly of FIG. 1A.

FIG. 3 shows an exploded view of the beverage bottle and retaining clip assembly of FIGS. 1A-2B. As shown, the cap 30 may include a valve 32 that releases fluid when the bottle 10 is squeezed, but sealed during regular use. In various embodiments, the valve 32 may be a silicone J or "Zel" valve, a spray valve, a bite valve, a dual valve, etc.

As also shown in FIG. 3, the retaining clip 20 includes a retaining clip bottle holder 21 and retaining clip base 40 that are joined together by the spring 50 at the pivot 45. The retaining clip bottle holder 21 and retaining clip base body 44 may be injection molded plastic. The retaining clip base 40 includes the retaining clip base body 44 that provides the structural basis of the retaining clip base 40. Retaining clip pad fabric 44 and a foam pad 60 encloses the retaining clip base body 44.

The pad 60 is adapted to improve the user's comfort. The pad 60 may be an elastomeric fabric pad 60 that is slid on from the bottom of the clip base up to the pivot 45 and then stretched around the finger pivot tab of the retaining clip base body 44 to secure the pad 60 in place. In such embodiments, the user may remove the fabric pad 60 for cleaning. Thinner versions of the pad may increase the stability of the system. Thicker versions may be more comfortable. A higher friction material, such as silicone, may be used on the pad 60 to keep it in place on the skin under sweaty conditions. The higher friction material may be provided as small circular bumps or strips to keep the pad in place. Alternatively, an elastomeric or rubber-like paint may be used. While clipped on a belt, the higher friction material may help to reduce movement with respects to shirt or short fabric, which may otherwise have a low coefficient of friction. In certain embodiments, the pad 60 may include a space to store personal items, such as an ID card 64 or a key. The storage space may be accessed using a storage tab 62.

It is believed that one of the keys to the improved function of the present design is in providing a wide and deep, padded, retaining clip base 40 for maximum stability and comfort.

The deep padded clip base 40 creates a longer pivot arm and helps to limit rocking of the bottle 10 away from the body due to flexing of the user's waistband. In addition, by locating the center of gravity of the bottle as close to the body as possible, it is possible to reduce or eliminate bottle rocking, even in heavy use conditions.

It is contemplated that by designing the back wall 24 of the retaining clip bottle holder 21 to be as narrow as possible, there is a greater grip clearance along the sides and some in back of bottle. It is contemplated that the increased grip area is important in preventing hand slippage, particularly when wearing running gloves or with wet or sweaty hands. The inward contour and finger recesses also provide a mechanical advantage and undercut surface to improve grip of the bottle 10. By making the bottle 10 narrow around the waist 11, the bottle 10 is easier to grip around the perimeter by users with smaller hands, and the bottle 10 is prevented from easily sliding up or down in the user's hand. In further embodiments, grip is improved by including patches of rough texture at expected grip points, such as the back waist of the bottle 10.

The retaining clip bottle holder 21 and/or retaining clip base 40 may include one or more stiffening ribs 48. The ribs may function to reduce flex and to secure the bottle 10 to a greater degree. The stiffening ribs 48 may also improve the grip of the retaining clip 20 to the belt or shorts. Further, the retaining clip bottle holder 21 and/or retaining clip base 40 may include vent holes 46 that permit airflow through the retaining clip to promote a cool, dry interface with the user's skin during physical activity.

It is contemplated that the bottle 10 may be further secured within the retaining clip 20 through the use of a small elastomeric band 80 that acts as a strap to secure the bottle 10 to the retaining clip 20 around the valve stem of the cap 30. The elastomeric band 80 may include a pull tab 82 to permit easy engagement and disengagement of the elastomeric band 80. The elastomeric band 80 may retract back into a channel in the retaining clip base body 44 and move clear of the bottle and cap reseating area. While some existing systems have used elastomeric bands, they do not move away from the bottle seating mechanism and may cause reseating issues.

Figure 4:
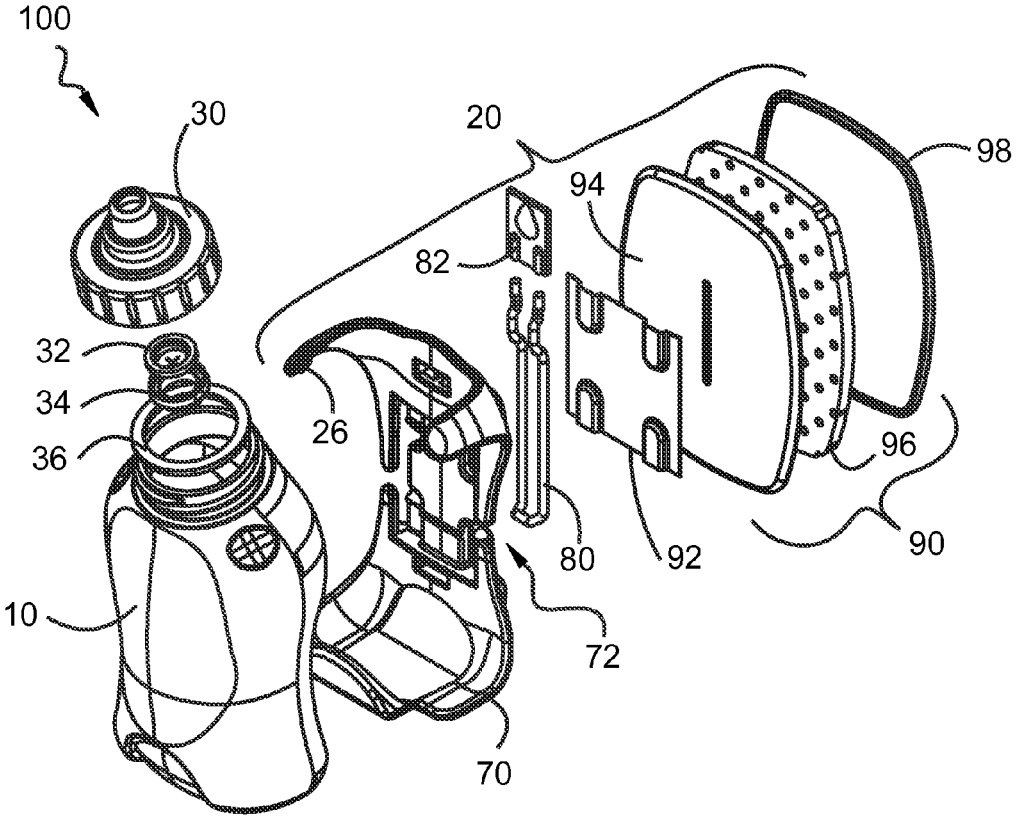
FIG. 4 is an exploded view of an example of a beverage bottle and retaining clip assembly designed to mate with a belt or armband.

As shown in FIG. 4, in alternate embodiments of the beverage bottle and retaining clip assembly 100, the retaining clip 20 is designed to mate with a belt or armband. In the embodiment shown in FIG. 4, the belt clip bottle holder 70 of the retaining clip 20 includes a passage 72 for securing the retaining clip 20 to a belt. The retaining clip 20 further includes belt pad 90 to provide stability to the retaining clip 20 and to pad the interface between the retaining clip 20 and the body. The belt pad 90 may include a belt pad strap fabric 92, belt pad fabric 92, belt pad foam 96, and belt pad chamois 98. The belt pad strap fabric 92 may secure the belt pad 90 to the belt clip bottle holder 70. The belt pad strap fabric 92 may be secured to the belt pad fabric 94 by sewing, gluing, etc. The belt pad fabric 94 and the belt pad chamois 98 may enclose the belt pad foam 96 and may be joined by sewing, gluing, etc.

Figure 5:
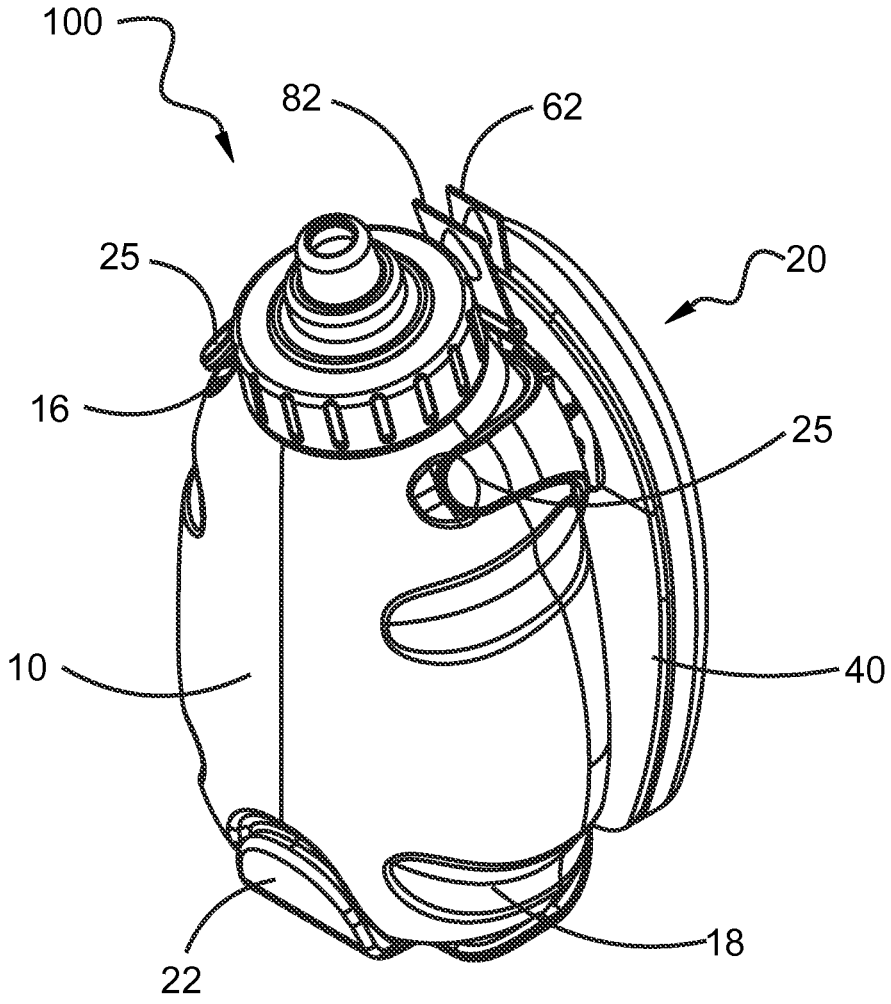
FIG. 5 is a front perspective view of an example of a beverage bottle and retaining clip assembly including a bottle with increased volume.

It is contemplated that there are numerous bottle shapes that may be employed in the presently disclosed system. The bottle shapes may assist in the function and efficiency of the system. For example, in the embodiment shown in FIGS. 1A-4, the bottle 10 may contour inward to conform to the user's hand and fingers. The inward contour of the bottle 10 may assist in improving the user's grip of the bottle. Alternatively, the embodiments of the bottle 10 shown in FIG. 5 may be adapted to have increased rigidity by providing side contours and finger recesses 18 that aids in preventing unplanned squirting while removing the bottle from the retaining clip 20. As shown in FIG. 5, in another example of the beverage bottle and retaining clip assembly 100, the bottle 10 may contour outward and include finger recesses at the top and bottom of the bottle 10 to improve the user's grip of the bottle 10. It is contemplated that the examples of bottles described may fit into the same retaining clip.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A wearable beverage bottle retaining clip comprising:

a back wall, including a top portion, bottom portion, a front face, and a rear face;

two shoulder tabs, each extending in front of the top portion of the back wall such that a first end of each shoulder tab is located in front of the front face of the back wall, wherein the shoulder tabs are at least partially hook-shaped and the first end of each shoulder tab is spaced apart across a width of the back wall;

a retaining seat extending in front of the bottom portion of the front face of the back wall, wherein the retaining seat includes a bottom tab that is configured such that when a beverage bottle is secured in the retaining clip, the bottom tab is in contact with the front face of the beverage bottle; and an elastomeric band including a pull tab that is retractable into a channel located inside the retaining clip base.

2. The beverage bottle retaining clip of claim 1 wherein at least one shoulder tab includes a mating protrusion located near the first end of the shoulder tab.

3. The beverage bottle retaining clip of claim 1 wherein the back wall is pivotally attached to a retaining clip base.

4. The beverage bottle retaining clip of claim 3 wherein the retaining clip base includes a pad.

5. The beverage bottle retaining clip of claim 4 wherein the retaining clip base further includes at least one vent hole.

6. The beverage bottle retaining clip of claim 1 wherein the shoulder tabs are integrally formed with the back wall.

7. The beverage bottle retaining clip of claim 1 wherein the retaining seat is integrally formed with the back wall.

8. The beverage bottle retaining clip of claim 1 wherein sides of the retaining seat are curved and tapered.

9. The beverage bottle retaining clip of claim 1 wherein the back wall includes inwardly contoured sides.

* * * * *